US011866999B2

(12) United States Patent
Kloft et al.

(10) Patent No.: US 11,866,999 B2
(45) Date of Patent: Jan. 9, 2024

(54) CUTTING ROLLER

(71) Applicant: HYDAC TECHNOLOGY GMBH, Sulzbach/Saar (DE)

(72) Inventors: Peter Kloft, Ransbach-Baumbach (DE); Jörg Meyer, Hohberg (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 78 days.

(21) Appl. No.: 17/261,320

(22) PCT Filed: Jun. 25, 2019

(86) PCT No.: PCT/EP2019/066755
§ 371 (c)(1),
(2) Date: Jan. 19, 2021

(87) PCT Pub. No.: WO2020/015958
PCT Pub. Date: Jan. 23, 2020

(65) Prior Publication Data

US 2021/0262292 A1 Aug. 26, 2021

(30) Foreign Application Priority Data

Jul. 20, 2018 (DE) ..... 10 2018 005 972.4

(51) Int. Cl.

| | |
|---|---|
| ***E21B 10/25*** | (2006.01) |
| ***E21B 10/24*** | (2006.01) |
| ***E21B 10/12*** | (2006.01) |
| ***E21D 9/10*** | (2006.01) |

(52) U.S. Cl.
CPC ..... *E21B 10/25* (2013.01); *E21B 10/12* (2013.01); *E21B 10/24* (2013.01); *E21D 9/104* (2013.01)

(58) Field of Classification Search
CPC ..... E21B 10/25; E21D 9/104; F16C 33/664; F16C 33/6677; F16C 2352/00; F16N 2270/60; F16N 19/006
See application file for complete search history.

(56) References Cited

U.S. PATENT DOCUMENTS 2,000,288 A * 5/1935 Hutchinson ..... B24B 5/185 451/140
2,038,293 A * 4/1936 Jacob ..... B60B 27/0005 384/473
2,040,802 A * 5/1936 Buckwalter ..... B60B 37/04 295/42.2

(Continued)

FOREIGN PATENT DOCUMENTS

CN 206174962 5/2017
DE 10 2012 220 434 6/2014

OTHER PUBLICATIONS

International Search Report (ISR) dated Sep. 4, 2019 in International (PCT) Application No. PCT/EP2019/066755.

*Primary Examiner* — Blake Michener
(74) *Attorney, Agent, or Firm* — WENDEROTH, LIND & PONACK, L.L.P.

(57) ABSTRACT

A cutting roller has an axle (2), on which a cutting ring (4) is rotatably guided by a bearing device (10, 12). The bearing device is sealed against the environment by a sealing device (28, 30). By a compensating device (40), any differential pressure between the bearing device (10, 12) and the environment is compensable.

15 Claims, 3 Drawing Sheets

(56) References Cited

U.S. PATENT DOCUMENTS 2,712,478 A * 7/1955 William ..... F16N 13/10 384/373
3,216,513 A * 11/1965 Robbins ..... F16C 19/49 384/93
3,230,020 A 1/1966 Gilbert et al.
3,413,045 A * 11/1968 Wohlfeld ..... F16C 13/02 175/325.3
3,917,028 A * 11/1975 Garner ..... F16C 33/6622 184/6.14
4,059,316 A * 11/1977 Alvarez ..... E21B 10/22 384/96
4,061,376 A * 12/1977 Villaloboz ..... E21B 10/24 384/93
4,073,548 A * 2/1978 Walters ..... F16J 15/32 384/93
4,102,552 A * 7/1978 Kellner ..... E21B 17/1064 175/325.3
4,161,223 A * 7/1979 Oelke ..... F16N 7/30 384/93
4,182,425 A * 1/1980 Garrett ..... E21B 10/52 175/371
4,248,484 A * 2/1981 Newcomb ..... E21B 10/24 384/94
4,261,426 A * 4/1981 Garrett ..... E21B 10/30 175/228
4,330,158 A * 5/1982 Walters ..... F16C 33/103 175/227
4,408,808 A * 10/1983 Redmann, Jr. ..... F16C 19/184 384/473
4,509,607 A * 4/1985 Saxman ..... F16C 33/664 175/227
4,593,775 A * 6/1986 Chaney ..... E21B 10/24 175/371
4,765,417 A * 8/1988 Perkin ..... E21B 10/24 175/347
4,792,000 A * 12/1988 Perkin ..... E21B 10/22 175/347
5,839,523 A 11/1998 Brolund
5,904,211 A 5/1999 Friant et al.
6,131,676 A 10/2000 Friant et al.
2010/0018778 A1 * 1/2010 Nanayakkara ..... E21B 10/25 175/371
2012/0212034 A1 8/2012 Shanahan et al.

* cited by examiner

CUTTING ROLLER

FIELD OF THE INVENTION

The invention relates to a cutting roller having an axle. On the axle, a cutting ring is rotatably guided by a bearing device, which is sealed against the environment by a sealing device.

BACKGROUND OF THE INVENTION

Cutting rollers of this type, that are used for mining of rock, are state of the art, see DE 10 2012 220 434 A1. In particular, such cutting rollers are used as cutting tools at the front end of the drill head of tunnel boring machines. During operation, the assigned sealing device protects the bearing device of the respective cutting rings against harmful environmental influences, such as the ingress of dirt and the like. However, the deep drilling depths frequently occurring in tunnel bores cause problems, if the drilling is performed under water or if water ingress occurs. Because of the water pressure, corresponding to the respective drilling depths, there is a water ingress despite the presence of the sealing device. In that way, the bearing device is destroyed.

SUMMARY OF THE INVENTION

In view of this issue, the invention addresses the problem of providing a cutting roller of the genus mentioned above, which can be reliably used for mining of rock, even if there is prevailing water pressure.

According to the invention, this problem is basically solved by a cutting roller having, as an essential feature of the invention, a compensating device by which differential pressures between the bearing device and the environment is compensable. Even when operating under water, the sealing device protects the bearing device reliably against water penetration based on the pressure compensation provided by the compensating device. The reliable operation is fail-safe in that way, even for deeper drilling sections where water pressure of up to 7 bar and more is to be expected.

In advantageous exemplary embodiments, the compensating device has an elastically flexible separator element. The inner side of the separator element is permanently pressurized at the environment pressure. The outer side of the separator element is connected to the bearing device in a pressurized manner. In that way, the separator element establishes environment pressure in the bearing device.

The arrangement can be particularly advantageous if the separator element is accommodated in a cavity of the axle. That cavity is connected to at least parts of the bearing device via a pressurized connection. In this way, the compensating device is completely integrated into the axle of the cutting roller, such that the cutting roller according to the invention can be built having a compact construction and without an increase in size compared to the known cutting rollers.

The separator element can advantageously have an accumulator bladder made of elastomeric material. The accumulator bladder is held on the fixed axle by a holding device, which has a connection channel that establishes a media connection between the interior of the separator element and the environment.

In advantageous exemplary embodiments, the holding device has an end cap, into which the connection channel opens out centrally. Supplying channels are connected to the connection channel. The supplying channels are inserted into the top of the cover in the form of grooves. The supplying channels ensure that the environment pressure is not only transmitted to the connection channel, and thus, to the bladder from a singular point in the environment, but also from a larger environment area covered by the supplying channels.

The bearing device may advantageously have at least two rolling bearings, in particular taper roller bearings interacting in pairs. Their gap and/or seat geometries are at least partially connected to the pressurized connection.

The arrangement can be advantageously such that the pressurized connection has at least one cross channel. One end of each cross channel opens out into the cavity of the axle. The other end of each cross channel opens out of this axle in the direction of a spacer sleeve. The spacer sleeve is adjoined by the inner ring of the respective rolling bearing on both sides.

The outer rings of the rolling bearing pair can be connected to the cutting ring, can be rotatable on the axle, and can be axially spaced apart from each other, parallel to the axis of rotation of the cutting ring, at a distance equal to or preferably greater than the length of the spacer sleeve.

With regard to the formation of the sealing device, the arrangement can advantageously be such that the sealing device has two pairs. Each pair has two sealing rings. One pair of sealing rings faces the bearing device, The other pair of sealing rings faces an end part. The end part is fixed on the axle and seals the bearing device at least against the environment.

The subject matter of the invention is also a tunnel boring machine having a drilling head, on which at least one cutting roller according to the invention is arranged.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
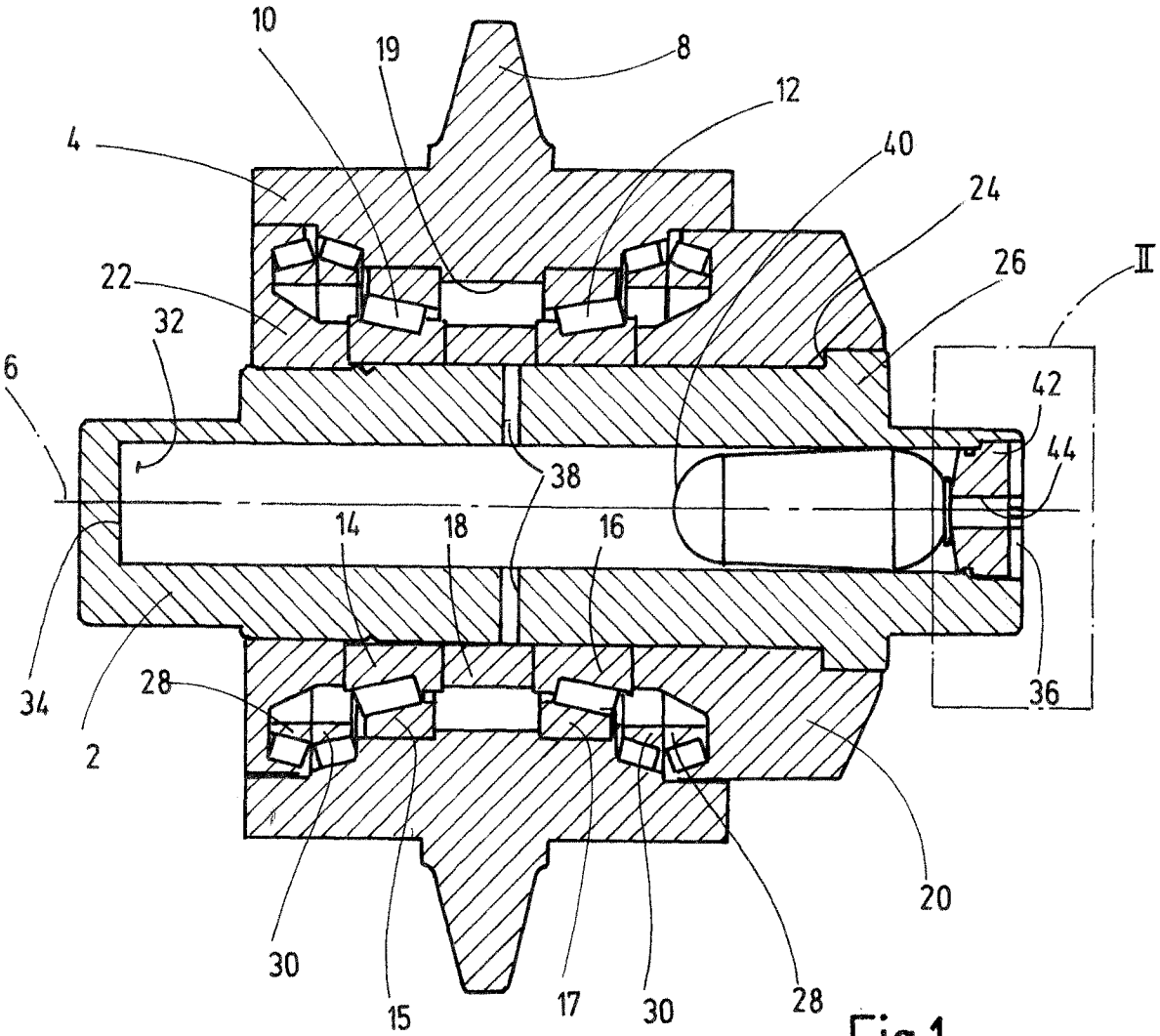
FIG. 1 is a schematically simplified, side view in section of a cutting roller according to a first exemplary embodiment of the invention.

The first exemplary embodiment, shown in FIG. 1, has a fixed axle 2, which defines the axis of rotation 6 for a cutting ring 4. The cutting ring 4 has a centrally located, radially protruding ring bulge 8, at the radially outer, tapered end of which cutting inserts are provided in the manner usual for cutting rollers of this type. The cutting inserts are omitted in the schematically simplified illustration of FIG. 1. The bearing device, forming the rotary bearing for the cutting ring 4, is formed by a pair of rolling bearings comprising a first taper roller bearing 10 and a second taper roller bearing 12. Respective inner rings 14, 16 of bearings 10, 12 surround the axle 2, are axially separated from each other and are held by a spacer sleeve 18. Bearing covers 20 and 22, seated on the axle 2, hold the inner rings 14 and 16 in contact with the spacer sleeve 18. A shoulder 24 of the bearing cover 20, located on the left in FIG. 1, is fixed to a radially projecting collar 26 of the axle 2. The opposite bearing cover 22, as a screw ring seated on the axle 2, forms the axial fixing of the bearing device in the opposite direction. The outer rings 15 and 17, supporting the cutting ring 4, of the taper roller bearings 10, 12 are held at an axial distance from each other by an inner collar 19 of the cutting ring 4. The distance is slightly larger than the axial length of the spacer sleeve 18. Two pairs of sealing rings 28 and 30 are provided for sealing the bearing device. The respective axially outer sealing ring 28 forms the sealing towards the fixed bearing cover 20 and/or 22. The respective axially inner sealing ring 30 forms the sealing towards the surrounding cutting ring 4.

Figure 2:
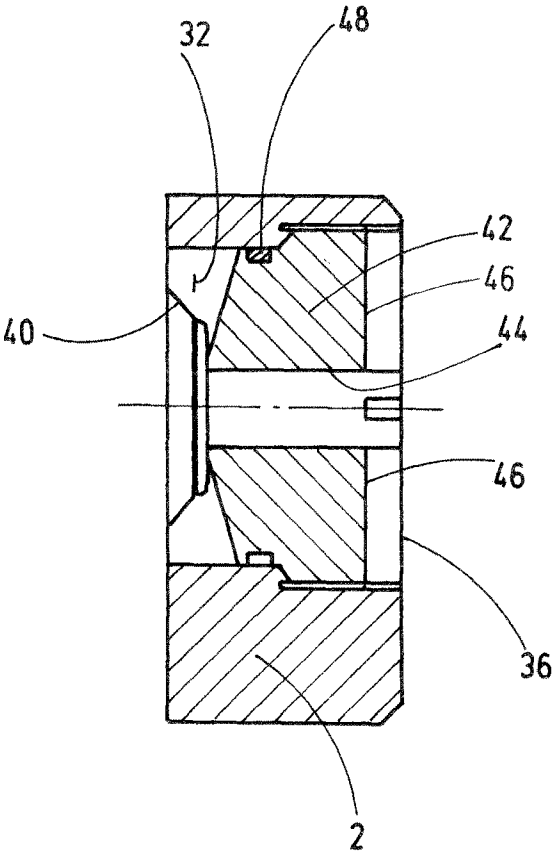
FIG. 2 is an enlarged, partial side view in section, magnified of the area designated by II in FIG. 1.
Figure 4:
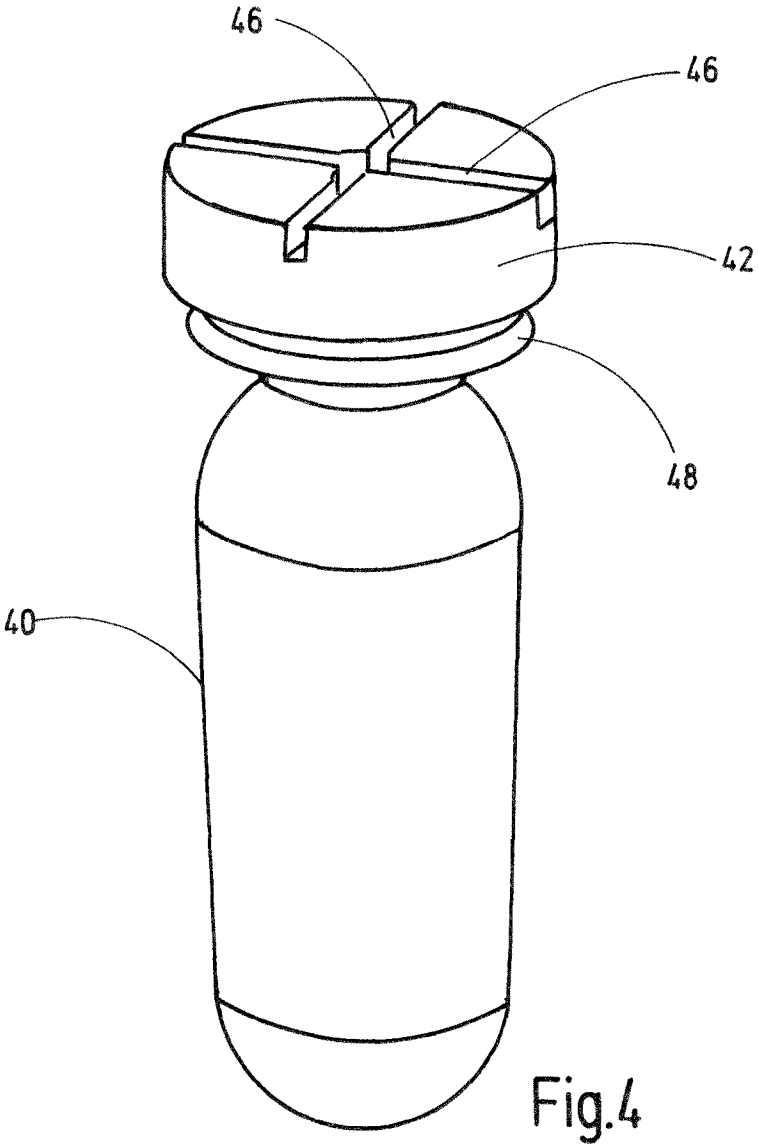
FIG. 4 is a perspective view of the accumulator bladder together with the holding device of FIG. 3.
Figure 5:
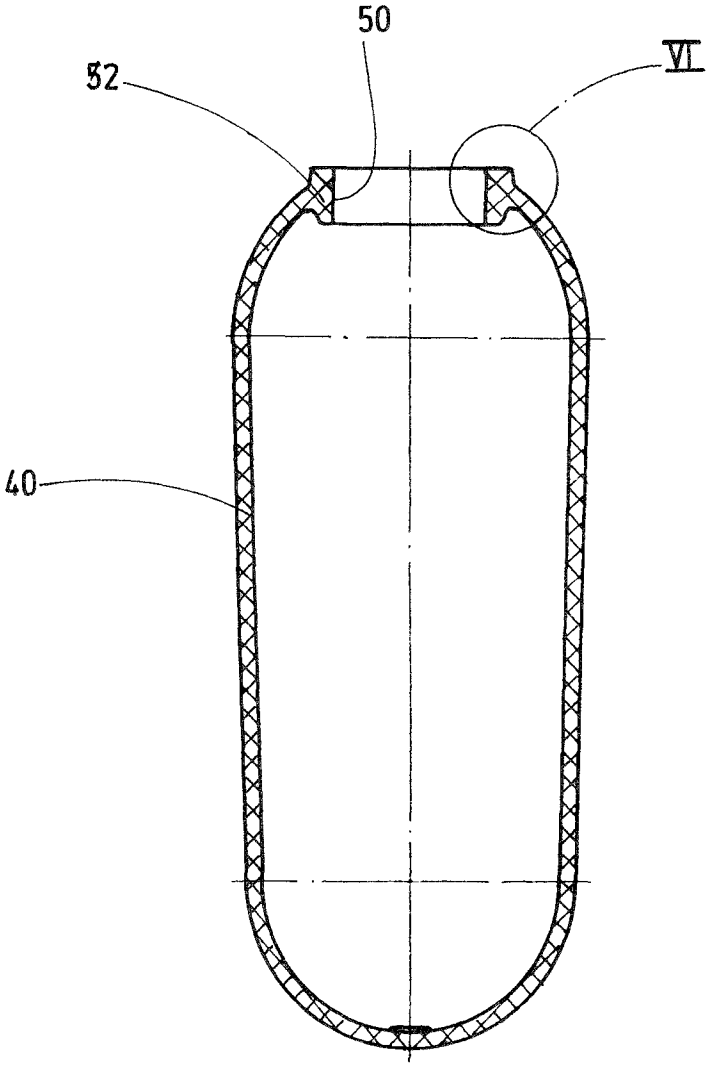
FIG. 5 is a side view in section of the separately shown accumulator bladder of FIG. 4.

The axle 2 has an internal or inner cavity 32, coaxial with the axis of rotation 6 and is closed at the end 34 on the left in FIG. 1 and open at the opposite end 36. Central within the length range, cross holes 38 open the cavity 32 of the axle 2 to the outer circumference. In this way, a media or fluid communication connection from the cavity 32 of the axle 2 to the inside of the bearing device is established via gaps located on the outer circumference of the axle in the area of the inner rings 14, 16 and the spacer sleeve 18. The cutting roller, according to the invention, has a compensating device or compensator, which provides a pressure compensation between the environment and the cavity 32, and thus, the bearing device. The compensating device has a movable separator element in the form of an elastically yielding accumulator bladder 40, which is shown separately in FIG. 5 and is made of an elastomer. As FIGS. 1 and 2 show most clearly, the accumulator bladder 40 is installed in the cavity 32 from the open end 36 of the cavity 32. The outside of the accumulator bladder 40 is connected then to the bearing device via the cross bores 38 in a pressurized manner. The inside of the accumulator bladder 40 is connected to the environment. To form this connection and as a support for the accumulator bladder 40, as FIG. 2 shows most clearly, as a supporting device or holder, an end cap 42 is provided. End cap 42 can be screwed into the open end 36 of the cavity 32 and has a coaxial connection channel 44, which provides the fluid communication connection between the environment and the inside of the accumulator bladder 40. As FIG. 4 shows most clearly, in the outside of the end cap 42 intersecting supplying channels 46 in the form of recessed grooves are formed. The connection to the environment is then formed across a larger area. A sealing ring 48 is used to seal the end cap 42 against the inner wall of the cavity 32.

Figure 3:
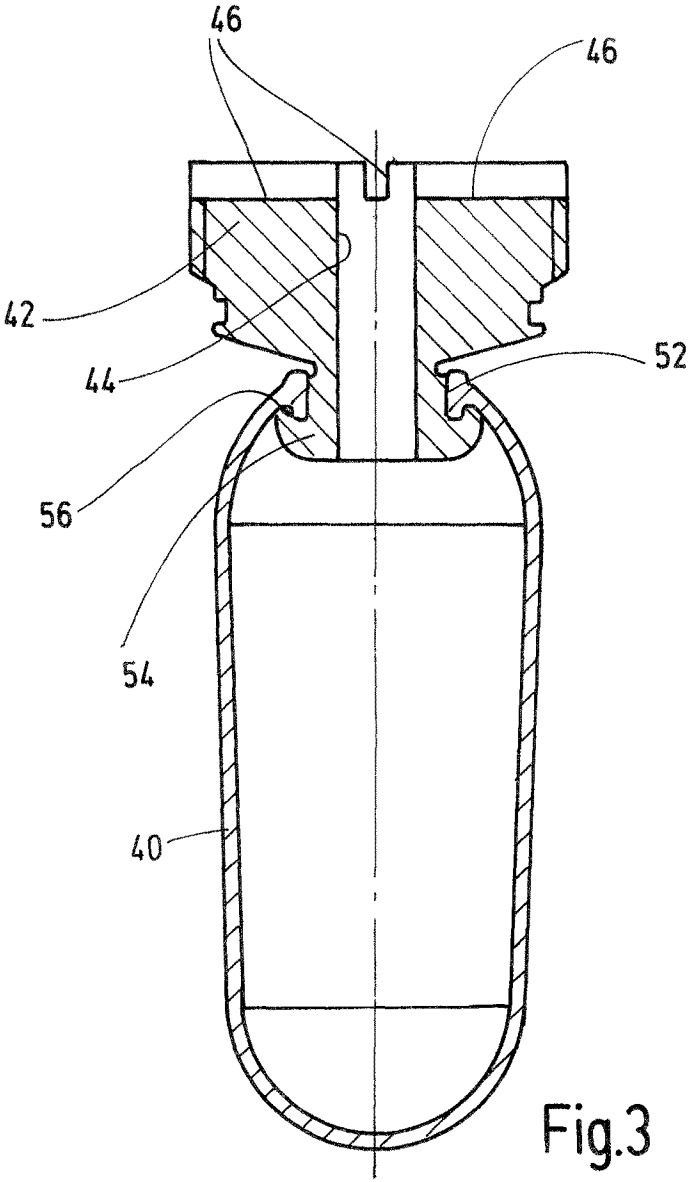
FIG. 3 is a side view in section of the bladder, forming a resilient separator element of the compensating device of the exemplary embodiment, together with an assigned holding device.
Figure 6:
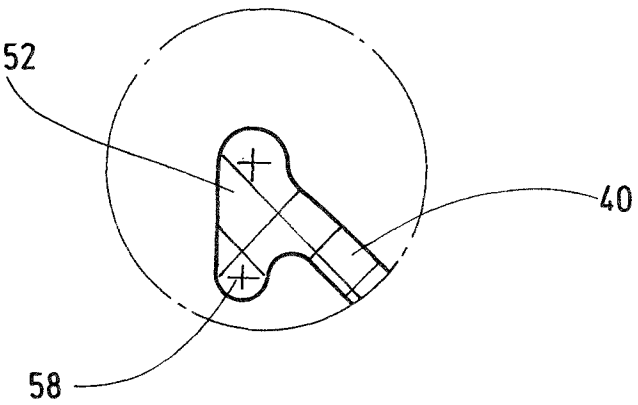
FIG. 6 is an enlarged, partial side view in section of a cutout of the area, designated by VI in FIG. 5, of the accumulator bladder.
Figure 7:
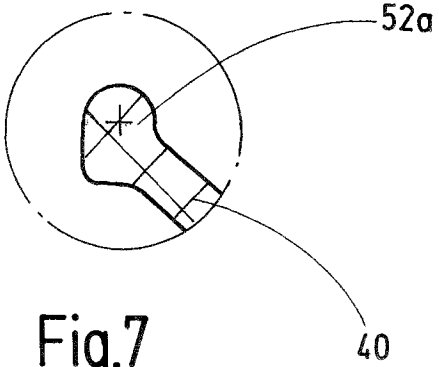
FIG. 7 is the partial cutout of FIG. 6 having an end part that has a modified outer shape according to a second exemplary embodiment of the invention.

The mechanical connection between the end cap 42, which forms the holding device, and the accumulator bladder 40 can be seen most clearly in FIGS. 3 and 5 to 7. As shown, the accumulator bladder 40 has at the open end an edge bulge 52, surrounding its opening 50. As shown in FIG. 3, the end cap 42 has at the inner end of the connection channel 44, an extension 54. Extension 54 has an annular groove formed by an undercut wall part 56 that engages behind an annular part 58 extending at the edge bulge 52 in the direction to the inside of the accumulator bladder 40. FIG. 7 shows a variant for the shape of the edge bulge 52*a*, which can be fixed in a correspondingly modified form of the annular groove (not shown) to the extension 54 of the end cap 42.

Because of the flexibility of the accumulator bladder 40, the spaces adjacent to the inside of the accumulator bladder 40 and those adjacent to the outside of the accumulator bladder 40 each have the same pressure level. If there is a water pressure, predominant in the environment and effective in the inside of the accumulator bladder 40 via the channels 44 and 46, the accumulator bladder 40 expands until the pressure between the inside of the bladder and the outside of the bladder, i.e. cavity 32, is balanced. This pressure balancing also results in a pressure compensation in the bearing unit via the cross bores 38, i.e. the internal bearing pressure is adjusted to the environment pressure. This pressure compensation ensures that the sealing device or seal in the form of the sealing ring pairs 28, 30, provides reliable protection of the taper roller bearings 10, 12 against environmental influences. The cutting roller according to the invention can then be safely operated even if an external water pressure occurs. The function of the accumulator bladder 40 described above can be further supported by a foam filling due to the permanent insertion of an elastically yielding foam material into the accumulator bladder 40.

While various embodiments have been chosen to illustrate the invention, it will be understood by those skilled in the art that various changes and modifications can be made therein without departing from the scope of the invention as defined in the claims.

The invention claimed is:

1. A cutting roller, comprising:

a fixed axle with an outside surface and an inner cavity;

a cutting ring rotatably guided on the outside surface of the axle by roller bearings between the cutting ring and the axle, at least part of the roller bearings being connected in fluid communication and being pressurized by pressure in the inner cavity;

a seal sealing the roller bearings from an environment outside of the axle and the cutting ring;

a compensator capable of compensating differential pressures between the roller bearings and the environment, the compensator including an elastically flexible separator element having an inside connected in fluid communication with the environment to be pressurized at environment pressure and having an outside connected in a pressurized manner to the roller bearings, the separator element being in the inner cavity of the axle, the separator element being held in the inner cavity of the axle by an end cap mounted in the inner cavity of the axle, the end cap having a connection channel extending axially through the end cap and having first and second grooves each extending completely across an exterior face of the end cap transversely to the connection channel, each having a constant width and depth, each being open radially outwardly to the environment along an entire length thereof and each being connected in fluid communication to the connection channel at a location that the first and second grooves cross one another; and a pressurized connection between the roller bearings and the inner cavity in the axle including a cross channel opening into the inner cavity at one end of the cross channel and opening out of the axle at another end of the cross channel.

2. A cutting roller according to claim 1 wherein
the roller bearings are taper roller bearings interacting in pairs.

3. A cutting roller according to claim 1 wherein
outer rings of the roller bearings are connected to the cutting ring, are rotatable relative to the axle and are axially spaced apart from each other along an axis of rotation of the cutting roller at an axial distance at least as great of an axial length of a spacer sleeve.

4. A cutting roller according to claim 3 wherein
the axial distance is greater that the axial length of the spacer sleeve.

5. A cutting roller according to claim 1 wherein
the seal comprises first and second pairs of two sealing rings, the first pair facing the bearing the roller bearings, the second pair facing an end part fixed on the axle and sealing the roller bearing from the environment.

6. A cutting roller according to claim 1 wherein
the cutting roller is arrangeable on a drilling head.

7. A cutting roller according to claim 1 wherein
the cross channel opens directly on an imperforate spacer sleeve adjoined to and engaging facing ends of an inner ring of each of the roller bearings.

8. A cutting roller according to claim 1 wherein
the end cap is threaded in the inner cavity of the axle.

9. A cutting roller, comprising:
a fixed axle with an outside surface and an inner cavity;
a cutting ring rotatably guided on the outside surface of the axle by roller bearings between the cutting ring and the axle, at least part of the roller bearings being connected in fluid communication and being pressurized by pressure in the inner cavity;
a seal sealing the roller bearings from an environment outside of the axle and the cutting ring;
a compensator capable of compensating differential pressures between the roller bearings and the environment, the compensator including an elastically flexible separator element having an inside connected in fluid communication with the environment to be pressurized at environment pressure and having an outside connected in a pressurized manner to the roller bearings, the separator element being in the inner cavity of the axle, the separator element being held in the inner cavity of the axle by an end cap coupled to the axle, the end cap having an extension with an undercut wall part forming an annular groove opening in a direction of an outer axial end of the end cap facing an environment outside of the axle, the separator element having an edge bulge surrounding an open end of the separator element, the edge bulge having an annular part engaged in the annular groove; and
a pressurized connection between the roller bearings and the inner cavity in the axle including a cross channel opening into the inner cavity at one end of the cross channel and opening out of the axle at another end of the cross channel.

10. A cutting roller according to claim 9 wherein
the separator element is an accumulator bladder.

11. A cutting roller according to claim 10 wherein
the end cap comprises a connection channel opening out centrally and being connected to supply channels in an end of the end cap remote from the accumulator bladder.

12. A cutting roller according to claim 9 wherein
the cutting ring comprises a radially outwardly projecting ring bulge on which cutting inserts are provided.

13. A cutting roller according to claim 9 wherein
the end cap is mounted in the inner cavity of the axle, the end cap having a connection channel extending axially through the end cap and having a groove extending across an exterior face of the end cap transversely to the connection channel and being connected in fluid communication to the connection channel and the open end of the separator element.

14. A cutting roller according to claim 13 wherein
the cutting ring comprises a radially outwardly projecting ring bulge on which cutting inserts are provided.

15. A cutting roller according to claim 9 wherein
the end cap is threaded in the inner cavity of the axle.

* * * * *